US007444090B2

(12) United States Patent
Nishida et al.

(10) Patent No.: US 7,444,090 B2
(45) Date of Patent: Oct. 28, 2008

(54) IMAGE FORMING APPARATUS FOR OUTPUTTING IMAGES WHILE OBTAINING TRANSFER OUTPUTS

(75) Inventors: Satoshi Nishida, Saitama (JP); Mikihiko Takada, Hino (JP); Shigetaka Kurosu, Hino (JP); Hiroshi Morimoto, Akiruno (JP); Kazuteru Ishizuka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/299,775

(22) Filed: Dec. 13, 2005

(65) Prior Publication Data

US 2006/0188277 A1 Aug. 24, 2006

(30) Foreign Application Priority Data

Feb. 21, 2005 (JP) ..... 2005-043791

(51) Int. Cl.
*G03G 15/00* (2006.01)

(52) U.S. Cl. ..... 399/49; 399/66

(58) Field of Classification Search ..... 399/49, 399/66

See application file for complete search history.

(56) References Cited

U.S. PATENT DOCUMENTS 5,983,044 A * 11/1999 Kodama et al. ..... 399/49
6,999,689 B2 * 2/2006 Kinoshita et al. ..... 399/49
7,035,562 B1 * 4/2006 Suzuki et al. ..... 399/66
7,139,511 B2 * 11/2006 Ishibashi ..... 399/159
2004/0042807 A1 * 3/2004 Nakayama ..... 399/49
2006/0188276 A1 * 8/2006 Nishida et al. ..... 399/49

FOREIGN PATENT DOCUMENTS

JP 2003-015371 1/2003
JP 2003-215888 7/2003
JP 2004157446 A * 6/2004

OTHER PUBLICATIONS

English abstract of JP 2004157446 A.*

* cited by examiner

*Primary Examiner*—David M. Gray
*Assistant Examiner*—Ryan D Walsh
(74) *Attorney, Agent, or Firm*—Finnegan, Henderson, Farabow, Garrett & Dunner, L.L.P.

(57) ABSTRACT

An image forming apparatus having plural image carriers, respective chargers, exposure units, color toner developing units, a black toner developing unit, a transfer unit that transfers in the transfer section the color toner images and black toner image onto an intermediate transfer member by the application of a transfer bias from the power supply unit, and a controller that controls the transfer output, an an optical density sensor that detects the optical density of color toner patch images formed on the intermediate transfer member, and a controller transfers the color toner patch images onto the intermediate transfer member while changing the transfer output, detects the optical densities of color toner patch images transferred onto the intermediate transfer member using the optical density sensor, and controls the transfer output to transfer the black toner image based on the detected optical densities of the color toner patch images.

7 Claims, 9 Drawing Sheets

IMAGE FORMING APPARATUS FOR OUTPUTTING IMAGES WHILE OBTAINING TRANSFER OUTPUTS

This application is based on Japanese Patent Application No. 2005-043791 filed on Feb. 21, 2005, which is incorporated hereinto by reference.

BACKGROUND OF THE INVENTION

The present invention relates to an image forming apparatus such as copier, laser beam printer, etc., and more specifically to an image forming apparatus that forms images using at least a black toner.

The conventional image forming apparatus using the electro-photographic method is described here referring to FIG. 10. FIG. 10 is an outline configuration diagram of an image forming apparatus using the conventional electro-photographic method. The image forming apparatus is a full-color electro-photographic image forming apparatus having four photoreceptor drums and an intermediate transfer member. The image forming apparatus is provided with four image forming sections 10Y, 10M, 10C, and 10K, which are configured to have, in the neighborhood of a photoreceptor drum 1Y for yellow color, a photoreceptor drum 1M for magenta color, a photoreceptor drum 1C for cyan color, and a photoreceptor drum 1K for black color, chargers 2Y, 2M, 2C, and 2K, exposure units 3Y, 3M, 3C, and 3K, developing units 4Y, 4M, 4C, and 4K, and cleaners 8Y, 8M, 8C, and 8K, and the images formed on the photoreceptor drums in each image forming section are successively transferred by the transfer unit onto the belt shaped intermediate transfer member 6 that is adjacent to and passed over the photoreceptor drums, and the image transferred onto the intermediate transfer member 6 is further transferred in a second transfer section onto a recording material P such as paper sheet etc.

In the present image forming apparatus, the image density may change due to changes in the environment, or due to changes with the passage of time, or due to changes in the characteristics of the transfer rollers or of the intermediate transfer member used; or due to changes in the physical characteristics of the toner, or due to changes in the characteristics of the photoreceptor, and in general, image forming apparatuses are provided with mechanisms for adjusting the image density, most of which have a means that automatically make the image density appropriate. In particular, in an image forming apparatus giving outputs of full color images, in order to obtain the desired color balance, more accurate control is being demanded for each of the colors yellow, magenta, cyan, and black.

The conventional control of image density is explained here. Toner patch images of colors other than black are formed on the image carriers, toner patch images are formed on the intermediate transfer member by transferring from the image carriers and their optical densities are detected, and also a toner patch image of the black color is formed on the image forming body, and the image density is being controlled by detecting the optical density of the toner patch image on this image forming body (Patent Document 1).

Further, toner patch images of color toners and black toner are formed on image carriers, the optical density of the toner patch image transferred from the image carriers onto the intermediate transfer member is detected, and the transfer output is being obtained based on this optical density and the developing bias value transfer output (Patent Document 2).

Patent Document 1: Japanese Unexamined Patent Application Open to Public Inspection No. 2003-215888.

Patent Document 2: Japanese Unexamined Patent Application Open to Public Inspection No. 2003-15371.

However, the following problems are present in the background technology described above.

1) In Patent Document 1, although the density of the black toner patch image on the photoreceptor is being detected, the density sensor output is particularly low in the case of a solid black toner patch image and it is difficult to obtain the optical density with a good accuracy.

2) In Patent Document 2, although the density of the black toner patch image on the image carrier is being detected, the density sensor output is particularly low in the case of a solid black toner patch image and it is difficult to obtain the optical density with a good accuracy, and further, although the relationship between the developing bias voltage and the transfer output is obtained beforehand and the transfer output is being obtained based on the developing bias voltage, it is particularly difficult to obtain accurately the black toner transfer output in cases when the characteristics of the transfer roller or of the intermediate transfer member changes due to changes in the environment or due to passage of time.

SUMMARY OF THE INVENTION

The present invention was made considering the above problems, and the object of the present invention is to provide an image forming apparatus that can output images of high quality while obtaining transfer outputs with a high accuracy using black toner, and in particular, while obtaining transfer outputs with a high accuracy using black toner even when the characteristics of the transfer roller or intermediate transfer member used change due to changes in the environment or due to passage of time, or even when there is some change in the physical characteristics of the toner, or some change in the characteristics of the photoreceptor.

Another object of the present invention is to an image forming apparatus that can output images of high quality while obtaining transfer outputs with a high accuracy using color toners and a black toner, and in particular, while obtaining transfer outputs with a high accuracy using color toners and a black toner even when the characteristics of the transfer roller or intermediate transfer member used change due to changes in the environment or due to passage of time, or even when there is some change in the physical characteristics of the toner, or some change in the characteristics of the photoreceptor.

The above purposes of the present invention can be achieved by any one of the following Structures (1) and (2).

(1) An image forming apparatus having image carriers, chargers that charge the image carriers, exposure units that expose the image carriers, color toner developing units that form color toner images by developing the exposed image carriers, black toner developing unit that forms black toner image by developing the exposed image carrier, a transfer unit that transfers in the transfer section the color toner images and black toner image onto an intermediate transfer member by the application of a transfer bias from the power supply unit, and a controller that controls the transfer output, with the image forming apparatus having the feature that it has a first optical density sensor that detects the optical density of color toner patch images formed on the intermediate transfer member, and the controller forms color toner patch images on the image carriers, and transfers the color toner patch images onto the intermediate transfer member while changing the transfer output, detects the optical densities of color toner patch images transferred onto the intermediate transfer member using the first optical density sensor, and based on the detected optical densities of the color toner patch images, controls the transfer output for the transfer unit to transfer the black toner image.

(2) An image forming apparatus having image carriers, chargers that charge the image carriers, exposure units that expose the image carriers, color toner developing units that form color toner images by developing the exposed image carriers, black toner developing unit that forms black toner image by developing the exposed image carrier, a transfer unit that transfers in the transfer section the color toner images and black toner image onto an intermediate transfer member by the application of a transfer bias voltage from the power supply unit, and a controller that controls the transfer output, with the image forming apparatus having the feature that it has a first optical density sensor that detects the optical density of color toner patch images formed on the intermediate transfer member, and has a toner adhesion amount detector that detects the amount of toner adhered on a black toner patch image having a half tone which is formed on the image carrier, and the controller forms color toner patch images on the image carriers, and transfers the color toner patch images onto the intermediate transfer member while changing the transfer output, detects the optical densities of color toner patch images transferred onto the intermediate transfer member using the first optical density sensor, obtains the transfer output for the transfer unit to transfer the color toner images based on the detected optical densities of the color toner patch images, obtains the correlation between the obtained transfer output for color toners with the developing bias voltage of color toner images, forms half tone black toner patch image on the image carrier, detects the amount of toner adhered in the black toner patch image using the toner adhesion amount detector, and determines the developing bias voltage applied to the black toner developing unit based on the detected amount of toner adhered and the corresponding exposure potential, and the controller, based on the correlation and on the determined developing bias voltage of black toner, controls the transfer output for the transfer unit to transfer the black toner image.

DETAILED DESCRIPTION OF THE PREFERRED EMBODIMENT

Figure 1:
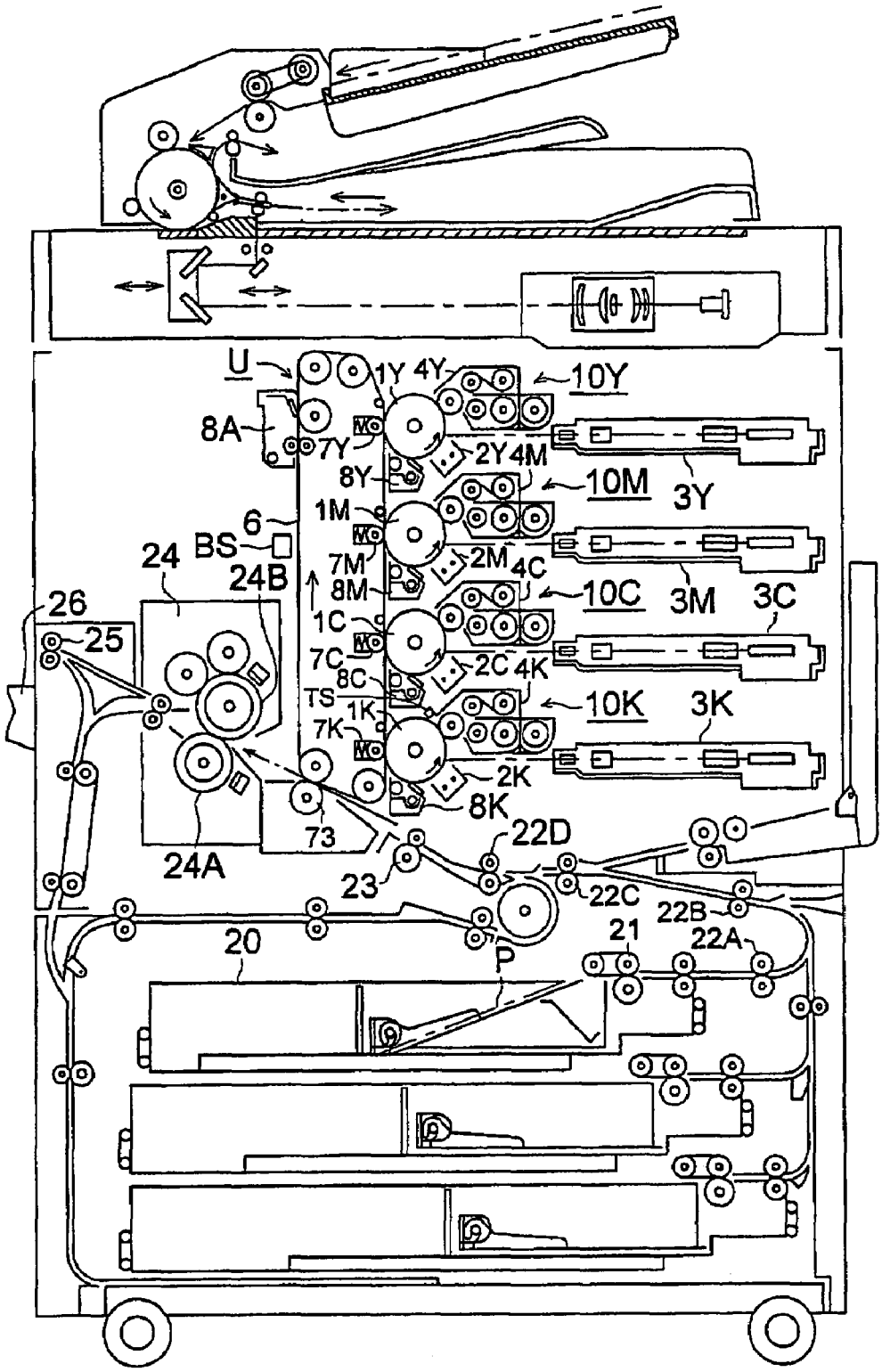
FIG. 1 is a cross-sectional diagram of important parts of an image forming apparatus according to a preferred embodiment of the present invention.

A preferred embodiment of the present invention is described here based on the attached drawings. FIG. 1 is a cross-sectional diagram of important parts of an image forming apparatus according to a preferred embodiment of the present invention. The image forming apparatus according to the present invention is a full-color electro-photography type image forming apparatus that has four photoreceptors and uses an intermediate transfer member. An image forming apparatus according to the present invention is described in detail in the following.

This image forming apparatus, as is shown in FIG. 1, is provided with four image forming sections constituted to have a charger, an exposure unit, a developing unit, and a cleaner in the neighborhood of a photoreceptor drum which is the photoreceptor, and the images formed on the photoreceptor in each image forming section are transferred successively in the transfer section onto an intermediate transfer member that is adjacent to and passes over the photoreceptor drums, and are further transferred in a second transfer section onto a recording medium such as paper sheet, etc.

The image forming apparatus according to the present invention is described in detail in the following. Each of the image forming sections 10Y, 10M, 10C, and 10K that form images of yellow, magenta, cyan, and black are provided with photoreceptor drums 1Y, 1M, 1C, and 1K, and each photoreceptor drum is free to rotate in the direction of the arrow in the figure (anti-clockwise direction). In addition, in the neighborhood of each photoreceptor drum 1Y, 1M, 1C, and 1K are provided the chargers 2Y, 2M, 2C, and 2K, the exposure units 3Y, 3M, 3C, and 3K, the color toner developing units 4Y, 4M, and 4C, the black toner developing unit 4K, and the cleaners 8Y, 8M, 8C, and 8K arranged successively along the direction of rotation of the photoreceptor drum.

Figure 2:
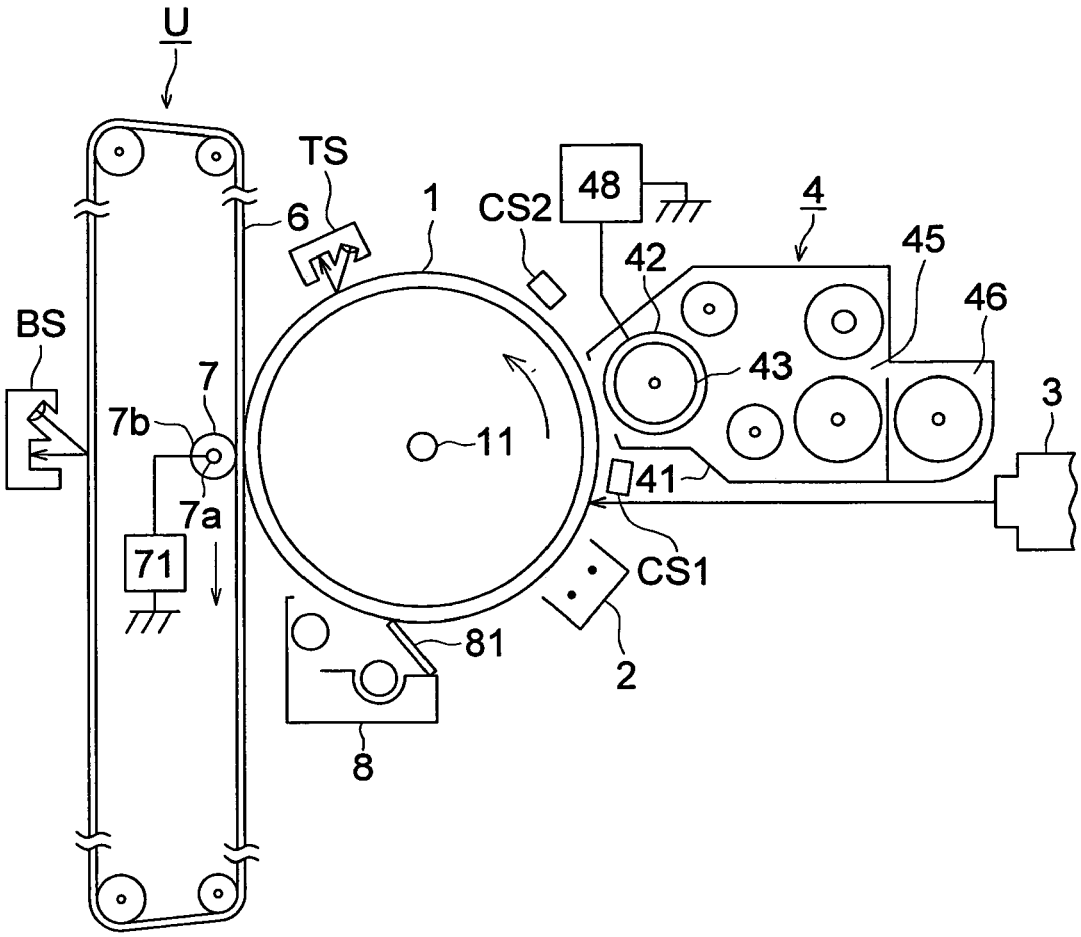
FIG. 2 is an outline configuration diagram showing an image forming apparatus and its surroundings according to a preferred embodiment of the present invention.

The image forming section is described in detail here referring to FIG. 2. FIG. 2 is an outline configuration diagram showing an image forming apparatus and its surroundings according to a preferred embodiment of the present invention. All the three color image forming sections 10Y, 10M, and 10C have the same configuration, and even the black toner image forming section 10K has the same configuration as the above three image forming sections excepting that the black toner image forming section 10K is provided with the potential sensors CS1 and CS2, and the optical density sensor TS that functions as the second optical density sensor, which are provided opposite the photoreceptor drum 1K, and hence the explanations given here omit the symbols Y, M, C, and K. This image forming section is provided with a photoreceptor drum 1 as the image carrier which is supported in a free to rotate manner by the body of the apparatus not shown in the figure. The photoreceptor drum 1 is a cylindrical shaped electrophotographic photoreceptor with a basic construction comprising a conductive base body made of aluminum etc., and a photoconductive layer formed on its periphery. It has a shaft 11 at its center, and is driven to rotate around this shaft 11 in the direction of the arrow by a driving source not shown in the figure.

The charger 2 is provided diagonally below the photoreceptor drum 1. The charger 2 charges the surface of the photoreceptor drum 1 uniformly to a prescribed potential of a prescribed polarity. Because of this, the surface of the photoreceptor drum 1 is charged uniformly.

The exposure unit 3 is provided on the downstream side of the charger 2 in the direction of rotation of the photoreceptor drum 1. The exposure unit 3 forms an electrostatic latent image on the photoreceptor drum 1 in accordance with the image information using a laser.

The developing unit 4 placed on the downstream side of the exposure unit 3 has a developer container 41 in which is placed a two-component developer comprising a toner and a carrier, and a developing sleeve 42 that is free to rotate is provided in the opening section of this developer container 41 facing the photoreceptor drum 1, and a magnet roller 43 that makes the developing sleeve 42 carry the developer is provided in the developing sleeve 42, so that it is fixed with respect to the rotation of the developing sleeve 42. Further, color toners are different from the black toner.

Further, a developing chamber 45 and a stirring chamber 46 are provided within the developer container 41 in a segmented manner. The toner image is formed on the photoreceptor drum 1 by applying the developing bias from the power supply 48 in the developing sleeve 42.

The transfer roller 7 which is the transferring unit is provided on the side of the photoreceptor drum 1 on the downstream side of the developing unit 4. The transfer roller 7 is constituted of a metal core 7*a* on the external periphery of which is provided a conductive layer 7*b*. The transfer roller 7 is pushed against the photoreceptor drum 1 by a pressing member, and the conductive layer 7*b* is pushed against the surface of the photoreceptor drum 1 via the intermediate transfer member 6 with a specific pressing force thereby forming the transfer nip section. The belt shaped intermediate transfer member 6 is gripped in the transfer nip section and the toner image on the photoreceptor drum 1 is transferred onto the surface of the intermediate transfer member 6 due to the application of the transfer bias from the power supply 71. In addition, the optical density sensor BS which is the first optical density sensor is provided opposite the intermediate transfer member 6.

The photoreceptor drum after transferring the toner image is cleaned by the cleaner 8 to remove the adherents on it such as residual toner, etc. The cleaner blade 81 collects the toner, etc., remaining on the surface of the photoreceptor drum 1.

In FIG. 1, the intermediate transfer units U are provided on the sides of each of the photoreceptor drums. The intermediate transfer unit U has a partially conducting endless belt shaped intermediate transfer member 6 that is wound round by a plurality of rollers and is supported in a free-to-rotate manner. This unit has the intermediate transfer member 6, the transfer unit comprising the primary transfer rollers 7Y, 7M, 7C, 7K and the secondary transfer roller 73, and also the intermediate transfer member cleaner 8A.

In an image forming apparatus of the above type, the color toner images and black toner image formed on the photoreceptor drums 1Y, 1M, 1C, and 1K are transferred successively onto the intermediate transfer member 6 in the transfer section by the primary transfer rollers 7Y, 7M, 7C, and 7K that function as the transfer unit and that are opposite the corresponding photoreceptor drums 1Y, 1M, 1C, and 1K with the intermediate transfer member 6 positioned in between them, and are transported along with the rotation of the intermediate transfer member 6 up to the secondary transfer roller 73 which is the secondary transfer section.

On the other hand, up to this point, the recording material P taken out from the sheet feeding cassette 20 is supplied via the pickup roller 21 to the transport rollers 22A, 22B, 22C, 22D, and 23, transported further towards the left in the figure, and in the secondary transfer section, the above toner image is transferred onto the recording material P by the secondary transfer bias applied to the secondary transfer roller 73. Further, the toner etc., remaining on the intermediate transfer member 6 after the transfer is removed and recovered by the intermediate transfer member cleaner 8A.

The fixing unit 24 comprises a fixing roller 24A that is placed in a free-to-rotate manner and a pressure roller 24B that rotates while pressing against the fixing roller 24A, thermal fixing is done when the recording material P passes between the fixing roller 24A and the pressure roller 24B, a full color image is formed on the recording material P, and the recording material P is discharged to the tray 26 by the discharge roller 25.

Further, the intermediate transfer member 6 has the shape of a belt, has carbon dispersed in it in order to control the electrical resistivity value, and is made of a black material. Since the density measurement of the toner patch image on the intermediate transfer member 6 is only for the color toners of yellow, magenta, and cyan, it is possible to detect the density with a good accuracy even when the intermediate transfer member 6 is made of a black material. However, conventionally, when detecting the black toner patch image on the intermediate transfer member using an optical density sensor, the amount of reflected light is small since the light gets absorbed, and for the black toner it was particularly difficult to detect changes in the amount of reflected light according to the amount of toner. The primary transfer rollers 7Y, 7M, 7C, and 7K have an external diameter of $\phi$20 mm, are made of partially conducting NBR sponge rubber (acrylonitrile-butadiene rubber), with a hardness of 25 degrees and a resistance value of $1\times^{7}\Omega$.

Figure 3:
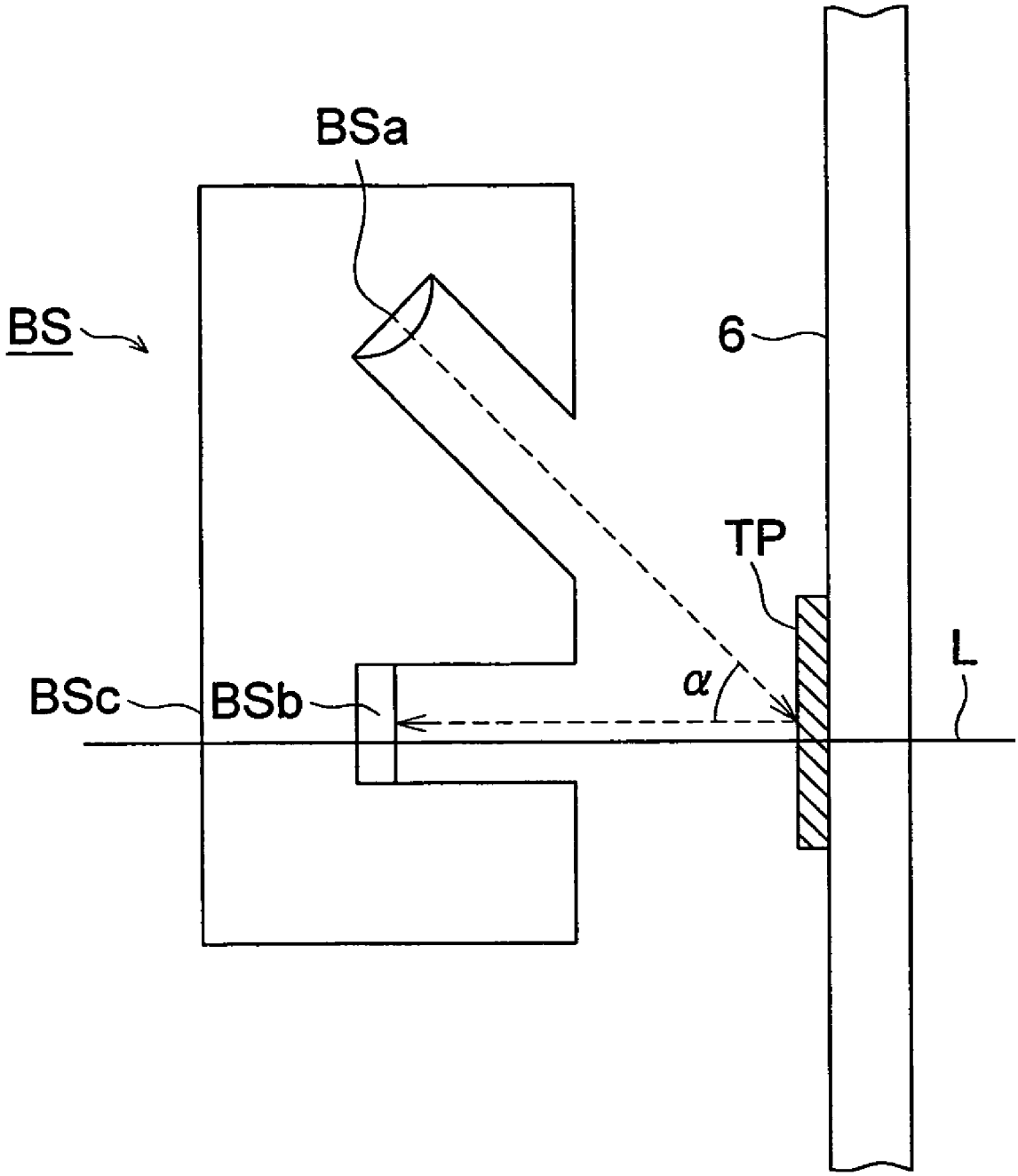
FIG. 3 is a schematic diagram of a first optical density sensor that detects the density of the toner patch image used for the control in the present preferred embodiment.

Next, a schematic diagram of a first optical density sensor BS that detects the density of a toner patch image used for the control in the present preferred embodiment is shown in FIG. 3. The optical density sensor BS is placed opposite to intermediate transfer member 6, is constituted to include a light emitting element such as an LED (light emitting diode) BSa, a light receiving element such as a photodiode BSb, and a holder BSc, and the density of a toner patch image is measured by making the infrared light from the light emitting element BSa to irradiate on the toner patch image TP on the intermediate transfer member 6, and measuring the light reflected from it using the light receiving element BSb. In order to make the regular reflected light from the toner patch image not to enter the light receiving element BSb, this optical density sensor BS is positioned, with reference to the normal line L, so that the angle of incidence of light on the toner patch image is $\alpha$=45°, and the angle of light reception of the light reflected from the toner patch image is 0° and only the random reflected light is measured. The optical density sensor BS measures the densities of a number of color toner patches. Further, even the optical density sensor TS used at the time of determining the developing bias of black toner image has the same structure as that of the optical density sensor BS.

Figure 4:
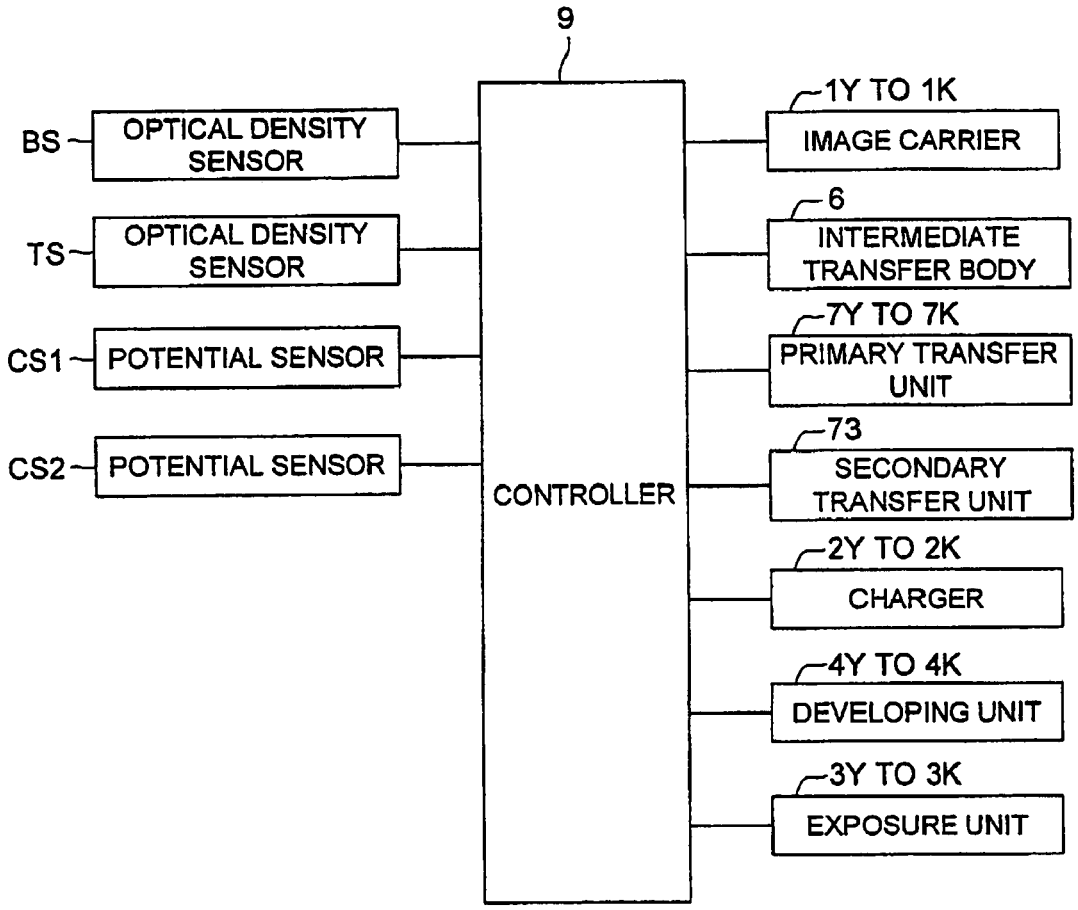
FIG. 4 is a block diagram of the controls in an image forming apparatus according to a preferred embodiment of the present invention.

Next, FIG. 4 shows a block diagram of the controls in an image forming apparatus according to this preferred embodiment of the present invention. The controller 9 controls each of the blocks and controls the transfer output for the transfer unit to transfer color toner images and black toner image. Further, the controller 9 carries out constant current control in order to control the current value of the transfer output.

BS is an optical density sensor to measure the density of color toner patch images on the intermediate transfer member and TS is an optical density sensor to measure the density of black toner patch images having half tones on the photoreceptor drum, and also, CS1 and CS2 sensors for detecting the potential on the surface of the photoreceptor drum.

Figure 5:
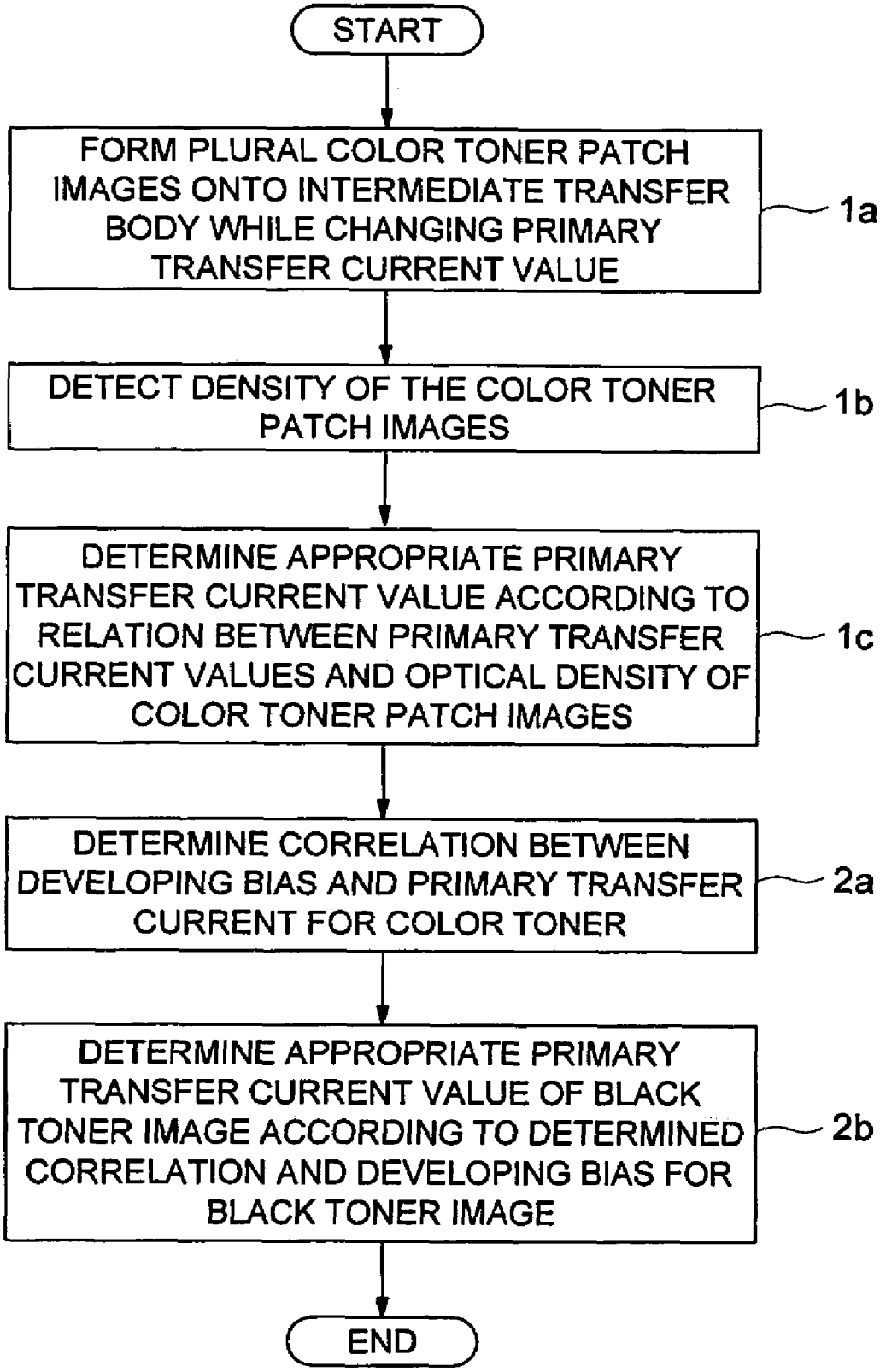
FIG. 5 is a flow chart showing the flow of controls of transfer output for a plurality of color toners and for the black toner.

Next, FIG. 5 shows a flow chart showing the flow of controls of transfer output for a plurality of color toners and for the black toner during the control of the transfer output by the controller for color toner images and black toner image.

Firstly, in Step 1*a,* color toner patch images are formed respectively on the photoreceptor drums in the image forming sections 10Y, 10M, and 10C, and the color toner patch images are transferred onto the intermediate transfer member by varying the primary transfer current value. However, before forming the color toner patch images, the developing DC bias voltage in the developing unit of each color toner is determined by carrying out compensation using so called Dmax compensation so that a toner image with a prescribed optical density is formed for the maximum optical density of the original document, and also the laser light intensity value is determined so that the half tone potential of the photoreceptor drum falls within a certain range.

The preparation of color toner patch images is carried out by preparing a plurality of solid toner patch images on the photoreceptor drum 1, and preparing a plurality of color toner patch images on the intermediate transfer member 6 while varying the primary transfer current value in the sequence $I_1$, $I_2$, . . . $I_J$ . . . $I_N$.

Next, in Step 1*b,* the optical densities $TD_1$ to $TD_N$ of the color toner patch images prepared in Step 1*a* above on the intermediate transfer member 6 are measured using the optical density sensor BS.

Next, in Step 1*c,* the appropriate primary transfer current value is determined from the relationship between the primary transfer current value and the optical densities of the color toner patch images.

Figure 6:
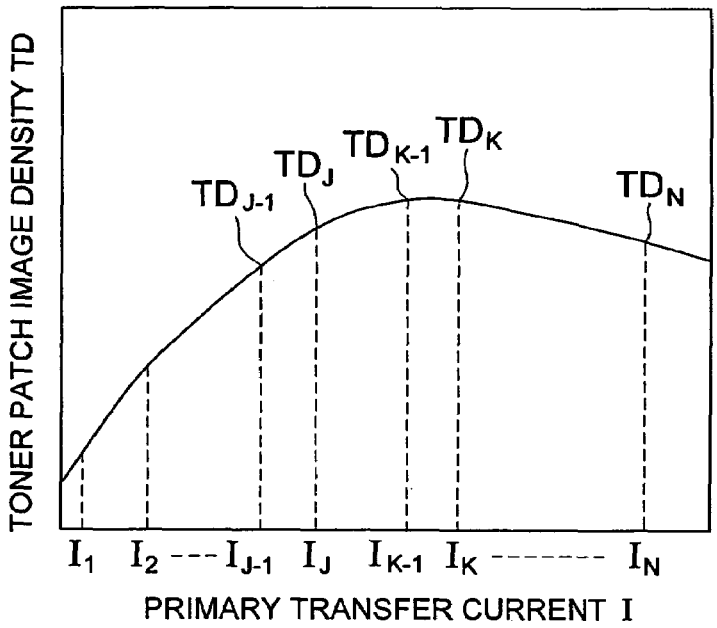
FIG. 6 is an explanatory diagram of the relationship between the primary transfer current and the toner patch image density and of obtaining the appropriate transfer output for black toner.

In the present preferred embodiment, taking the optical density of the color toner patch image as $TD_J$ when the primary transfer current value $I_J$, when $TD_J \leqq TD_{J-1}$, that is, when the primary transfer current value is $I_K$ near the maximum optical density of the color toner patch image, this $I_K$ is determined as the primary transfer current value of the color toner. This relationship is shown in FIG. 6. FIG. 6 is an explanatory diagram of the relationship between the primary transfer current I and the toner patch image density TD and of obtaining the appropriate transfer output for color toners.

Figure 7:
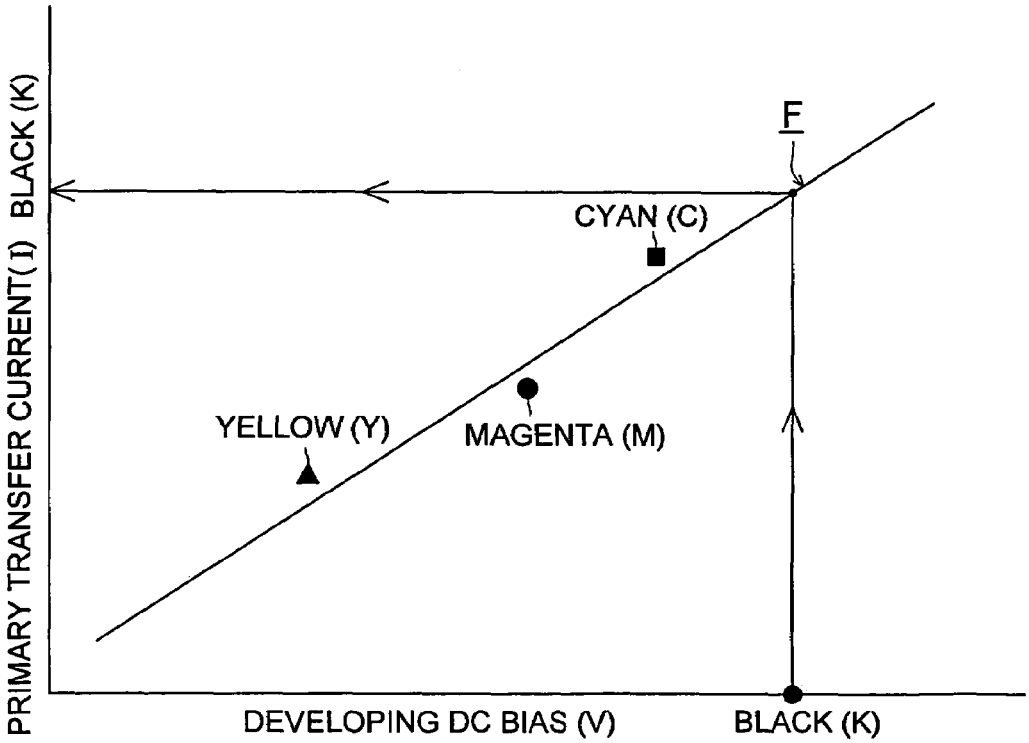
FIG. 7 is a diagram showing the relationship between the developing bias and the primary transfer current and their correlation.

In Step 2*a,* the correlation between the developing DC bias voltage (developing bias) for color toner and the primary transfer current is obtained. In concrete terms, the data is plotted as a graph taking the developing DC bias value obtained in Step 1*a* for color toners along the horizontal axis and the primary current value obtained in Step 1*c* along the vertical axis, and based on this plotted point, the correlation function F between the developing DC bias voltage and the primary transfer current is obtained by the least squares method. This relationship is shown in FIG. 7. FIG. 7 is a diagram showing the relationship between the developing DC bias voltage and the primary transfer current and their correlation function F.

In Step 2*b,* using the correlation function F obtained in Step 2*a* and the developing bias voltage of black toner image, the appropriate primary transfer current value of black toner image is determined (transfer output value). In specific terms, this half tone black toner patch image is formed on the photoreceptor drum. Further, a half tone black toner patch image is a toner patch image with a density in the range from low density upto high density excluding the maximum density (solid black toner patch image density). The density of this half tone black toner patch image can be measured with a good accuracy using optical density measurement. In the condition in which the surface of the photoreceptor drum 1K is charged uniformly by the charger to a charging potential VH, exposure operation is made to the part of forming the black toner patch image (black toner patch portion) using the exposure unit (FIG. 2), and the latent image potential VL of the black toner patch portion is detected by the potential sensor CS1 (FIG. 2). After completing the potential detection, the black toner patch portion is developed by passing it through the developing unit 4 thereby forming the black toner patch image, and the potential VDC of the black toner patch image is detected by the potential sensor CS2 (FIG. 2). Next, the absolute value |VDC−VL| of the difference between the potential VDC and the latent image potential VL is obtained.

On the other hand, the optical density of the half tone black toner patch image on the photoreceptor drum is detected by the optical density sensor TS (FIG. 2). Here, based on a table obtained beforehand by experiment of the relationship between the optical density and the amount of toner adhesion, the amount of toner adhesion Mt on the photoreceptor drum is obtained from the detected optical density of the black toner patch image. The means that detects the amount of toner adhesion in the half tone black toner patch image formed on the image carrier (photoreceptor drum) is called the toner adhesion amount detector.

Figure 8:
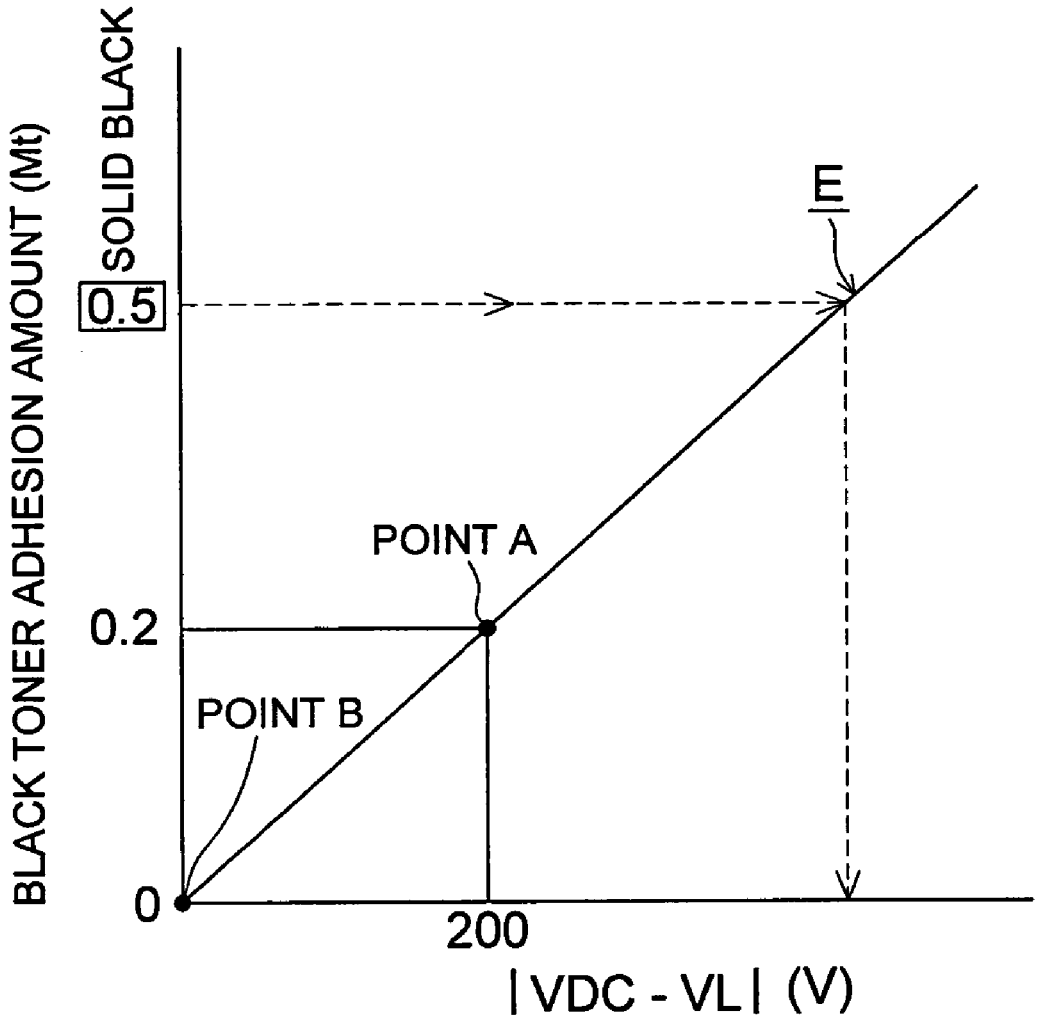
FIG. 8 is a diagram showing the relationship between |VDC−VL| of black toner and the amount of black toner adhesion.

In the above manner, the relationship between |VDC−VL| and the amount of toner adhesion Mt is obtained. This relationship is shown in FIG. 8. FIG. 8 is a diagram showing the relationship between |VDC−VL| of black toner and the amount of black toner adhesion.

As is shown in FIG. 8, the data of |VDC−VL| and the amount of toner adhesion Mt obtained earlier is plotted with |VDC−VL| along the horizontal axis and the amount of toner adhesion Mt along the vertical axis. For example, taking |VDC−VL|=200 (V) and the amount of toner adhesion Mt=0.2 (mg/cm$^2$), the point with these coordinates is taken as point A. Further, the origin of these coordinates is taken as point B, and the correlation E between |VDC−VL| and the amount of toner adhesion Mt is obtained from the two points, point A and point B. Using this correlation E, the value of |VDC−VL| is obtained assuming that the amount of toner adhesion Mt to be 0.5 (mg/cm$^2$). Here, the value of the latent image potential VL is added and the appropriate developing DC bias voltage (developing bias) for black toner is determined. Further, although the correlation E was obtained using two points in this explanation, it is possible to use a plurality of points.

Next, the primary transfer current value (transfer output value) for black toner image is determined. In specific terms, using the correlation function F between the developing DC bias obtained in Step 2*a* and shown in FIG. 7 and the primary transfer current, the appropriate primary transfer current value for black toner image is obtained corresponding to the appropriate developing DC bias value for black toner image.

In the above manner, by detecting the optical densities of color toner patch images and half tone black toner patch image, it is possible to determine the appropriate primary transfer current value (transfer output value) for black toner image.

Figure 9:
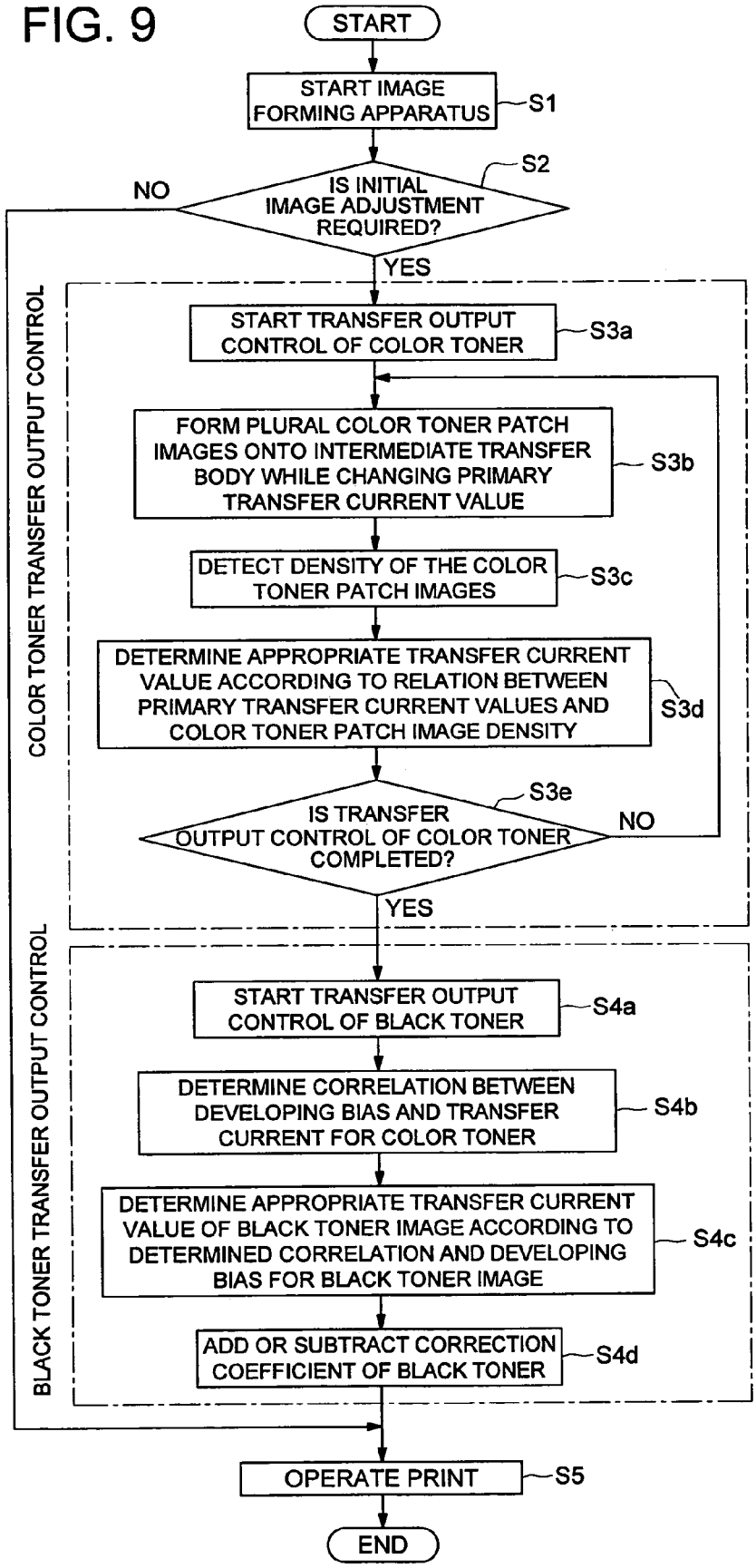
FIG. 9 is a flow chart showing the flow of control carrying out adjustment of the transfer output during the idling mode of the image forming apparatus.
Figure 10:
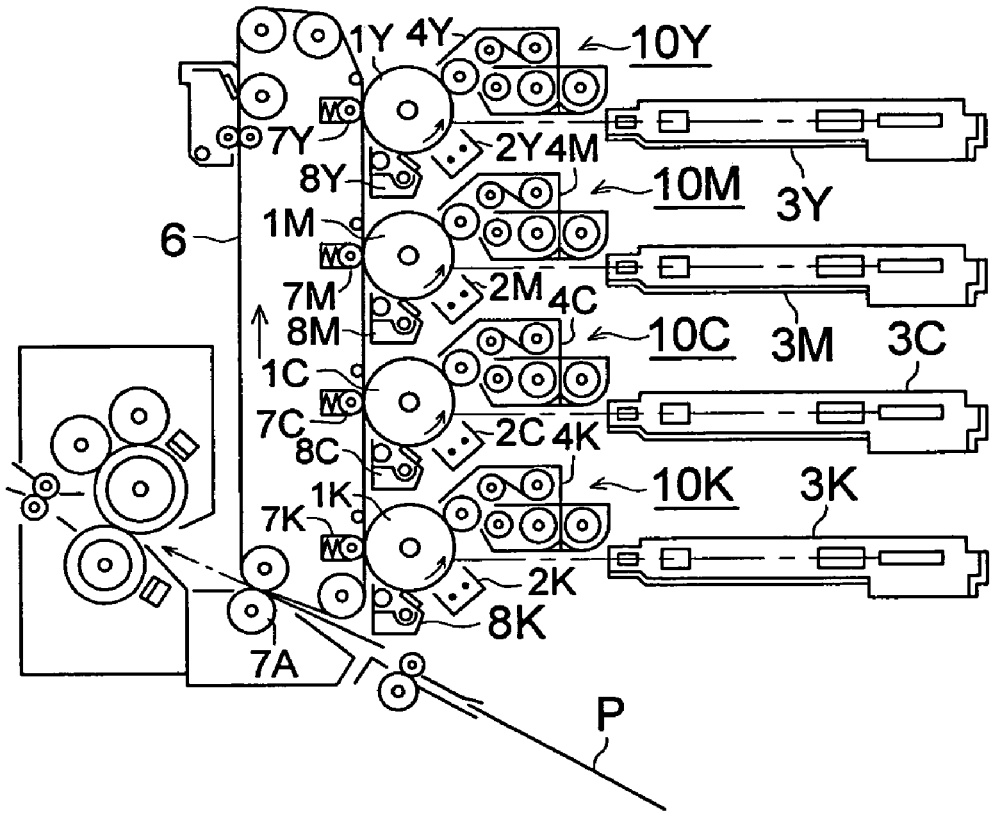
FIG. 10 PRIOR ART
FIG. 10 is an outline configuration diagram of an image forming apparatus using the conventional electro-photographic method.

Next, an example is described in which the control of transfer output according to the present invention is applied during the idling mode. FIG. 9 is a flow chart showing the flow of control carrying out adjustment of the transfer output during the idling mode of the image forming apparatus.

As is shown in FIG. 9, the image forming apparatus is started in Step S1.

Next, in Step S2, in the initial stage after starting, a judgment is made as to whether or not it is necessary to carry out adjustment control of this transfer output. A check is made as to whether or not the initial image adjustment operation is to be carried out, for example, a check is made if the operation of the equipment is being started for the first time in the morning after the use of the image forming apparatus had been stopped previously by checking if the stopped time of the image forming apparatus eight hours or more continuously. If adjustment is necessary (YES), the operation proceeds to Step S3*a*, and if it is not necessary, the operation proceeds to the print operation of Step S5.

In Step S3*a*, the transfer output control is started of obtaining the transfer output for color toners.

Step S3*b* to Step S3*d* are similar to the contents of Step 1*a* to Step 1*c* described above using FIG. 5.

In Step S3*e*, a judgment is made as to whether or not the control of transfer output for color toners has been completed, and if it has not been completed (NO), the operation returns to Step S3*b*. If it has been completed (YES), the operation proceeds to Step S4.

In Step S4*a*, transfer output control of obtaining the transfer output for black toner is started. Step S4*b* and Step S4*c* are similar to Step 2*a* and Step 2*b* described above using FIG. 5. In Step S4*d*, compensation is carried out using the obtained transfer output for black toner. Next, the print operation is made in Step S5.

In the above manner, the transfer output for black toner is obtained with a good accuracy, and in particular, high quality image can be output because the transfer output for black toner can be obtained even when there is any change in the characteristics of the transfer roller or intermediate transfer member, the physical characteristics of the toner, or in the characteristics of the photoreceptor. In addition, even the transfer output for color toners also can be obtained with a good accuracy and it is possible to output images of a high quality.

Further, although the explanation of the preferred embodiment was that of an image forming apparatus that forms toner images on a plurality of image carriers, transfers them to an intermediate transfer member, and then transfers the image to the recording material, it is not necessary to restrict the present invention to this, but it is possible, for example, to replace a plurality of image carriers with a single image carrier, and the invention can be applied even in the case of an image forming apparatus in which the intermediate transfer member is replaced with a drum shaped intermediate transfer member. In addition, the present invention can also be applied to an image forming apparatus of the multiple development intermediate transfer method in which toner images are formed successively on the same image carrier, these toner images are superimposed by transferring onto an intermediate transfer member, and then the superimposed toner images are transferred in one operation onto a recording material.

What is claimed is:

1. An image forming apparatus comprising:

(a) an image carrier;

(b) a charger for charging the image carrier;

(c) an exposure unit for imagewise exposing the image carrier;

(d) a color toner developing unit for developing the image carrier to form a color toner image;

(e) a black toner developing unit for developing the image carrier to form a black toner image;

(f) a transfer unit for transferring the color toner image and the black toner image, by respectively applying a transfer bias voltage from a power source at each of a transfer section, onto an intermediate transfer member made of a black material;

(g) a controller for controlling a transfer output of the transfer unit;

(h) an optical density sensor for detecting each of optical densities of color toner patch images formed on the intermediate transfer member; and (i) a toner adhesion amount detector that detects an amount of toner adhered of a black toner patch image formed on the image carrier, wherein the controller forms color toner patch images for yellow, magenta and cyan on the image carrier, transfers the color toner patch images onto the intermediate transfer member while changing the transfer output of the transfer unit, detects the optical density of each of the color toner patch images transferred onto the intermediate transfer member using the optical density sensor, obtains the transfer output for the transfer unit to transfer the color toner images based on the detected optical densities of the color toner patch images, obtains a correlation between the obtained transfer output for color toners and a developing condition of each of the color toner images, forms the black toner patch image on the image carrier, detects the amount of toner adhered on the black toner patch image using the toner adhesion amount detector, and determines the developing condition for the black toner developing unit based on the detected amount of toner adhered and a corresponding exposure potential, and the controller determines the transfer output of the transfer unit to transfer the black toner image, based on the correlation and on the determined developing condition for black toner.

2. The image forming apparatus of claim 1, wherein the controller carries out a constant control to control a current value of the transfer output.

3. The image forming apparatus of claim 1, wherein the developer is a two-component developer comprising a toner and a carrier.

4. The image forming apparatus of claim 1, wherein each of the color toners is a toner other than the black toner.

5. The image forming apparatus of claim 1, wherein the developing condition corresponds to a developing voltage.

6. The image forming apparatus of claim 5, wherein the developing bias voltage of each of the color toner images is obtained on the basis of Dmax compensation on each of the color toner patch images.

7. The image forming apparatus of claim 1, wherein the black toner patch image formed on the image carrier is a half tone image.

* * * * *